US006264523B1

(12) United States Patent
Simmons

(10) Patent No.: US 6,264,523 B1
(45) Date of Patent: Jul. 24, 2001

(54) COMMUNICATING TOY

(75) Inventor: Deborah Wong Simmons, Kowloon (HK)

(73) Assignee: Tri-State (Far East Corporation (HK)

( * ) Notice: Subject to any disclaimer, the term of this patent is extended or adjusted under 35 U.S.C. 154(b) by 0 days.

(21) Appl. No.: 09/280,288

(22) Filed: Mar. 29, 1999

(51) Int. Cl.[7] ..... A63H 3/28

(52) U.S. Cl. ..... 446/143; 446/297; 434/169; 434/201

(58) Field of Search ..... 434/156, 159, 434/169, 201; 446/143, 268, 297, 302, 404

(56) References Cited

U.S. PATENT DOCUMENTS

| | | | | |
|---|---|---|---|---|
| 4,451,911 | | 5/1984 | Klose . | |
| 4,840,602 | * | 6/1989 | Rose | 446/297 X |
| 5,478,240 | | 12/1995 | Cogliano . | |
| 5,655,945 | * | 8/1997 | Jani | 446/175 |
| 5,746,602 | * | 5/1998 | Kikinis | 434/169 |
| 5,944,533 | * | 8/1999 | Wood | 434/169 X |

FOREIGN PATENT DOCUMENTS

| | | | | |
|---|---|---|---|---|
| 3 404 260A | | 11/1984 | (DE) . | |
| 214013 | * | 3/1987 | (EP) | 446/297 |
| 2029715 | * | 3/1980 | (GB) | 446/302 |
| 2133951 | * | 8/1984 | (GB) | 446/302 |
| 2 201 068A | | 8/1988 | (GB) . | |
| 7522 | * | 12/1987 | (WO) | 446/297 |

* cited by examiner

*Primary Examiner*—John A. Ricci
(74) *Attorney, Agent, or Firm*—Paul J. Sutton

(57) ABSTRACT

A communication system includes a talking doll arranged to speak to a user and to request the user to carry out various tasks. The user responds to such requests by selecting and pressing keys on a remote keyboard. The doll and the keyboard communicate using infra-red signalling. The system is programmed so that the doll can respond to the user's selection and to say whether the selection is correct or not.

8 Claims, 3 Drawing Sheets

COMMUNICATING TOY

BACKGROUND OF THE INVENTION

1. Field of the Invention

The invention relates to communicating toys.

2. Description of the Prior Art

The invention relates more particularly to a toy that communicates using infra-red signalling. It is already known for two dolls to "communicate" with each other using infra-red signalling to simulate a simple conversation. The doll user cannot easily interact with the communication in any significant or meaningful manner. This means the present talking or communication dolls are not particularly stimulating intellectually, or useful as an educational aid for example.

SUMMARY OF THE INVENTION

It is an object of the invention to overcome or at least reduce this problem.

According to the invention there is provided a communication system for a talking doll using infra-red signals, including a microprocessor and a keyboard, a first transceiver at the doll and a second transceiver at the keyboard, in which microprocessor is programmed to respond to interrogations signals received at the second transceiver from the first transceiver to respond to user chosen consequential operations of the keyboard, and to cause comment signals to pass from the second transceiver to the first transceiver to enable the doll to verbally react to each chosen keyboard operation.

The system preferably includes a manually operated switch mounted to the doll to "wake-up" a doll power supply in the doll.

The communication system may include one or more selectively operated switches mounted to the doll to initiate respective signals at the first transceiver.

Each switch may be mounted inside the doll and operated by manually pressing against an outer surface of the doll.

The keyboard includes keys for each of a number of letters, keys for each of a plurality of different numbers and/or shapes.

BRIEF DESCRIPTION OF THE DRAWINGS

A communicating system for a talking doll according to the invention will now be described by way of example with reference to the accompanying drawings in which.

DESCRIPTION OF THE PREFERRED EMBODIMENTS

Figure 1:
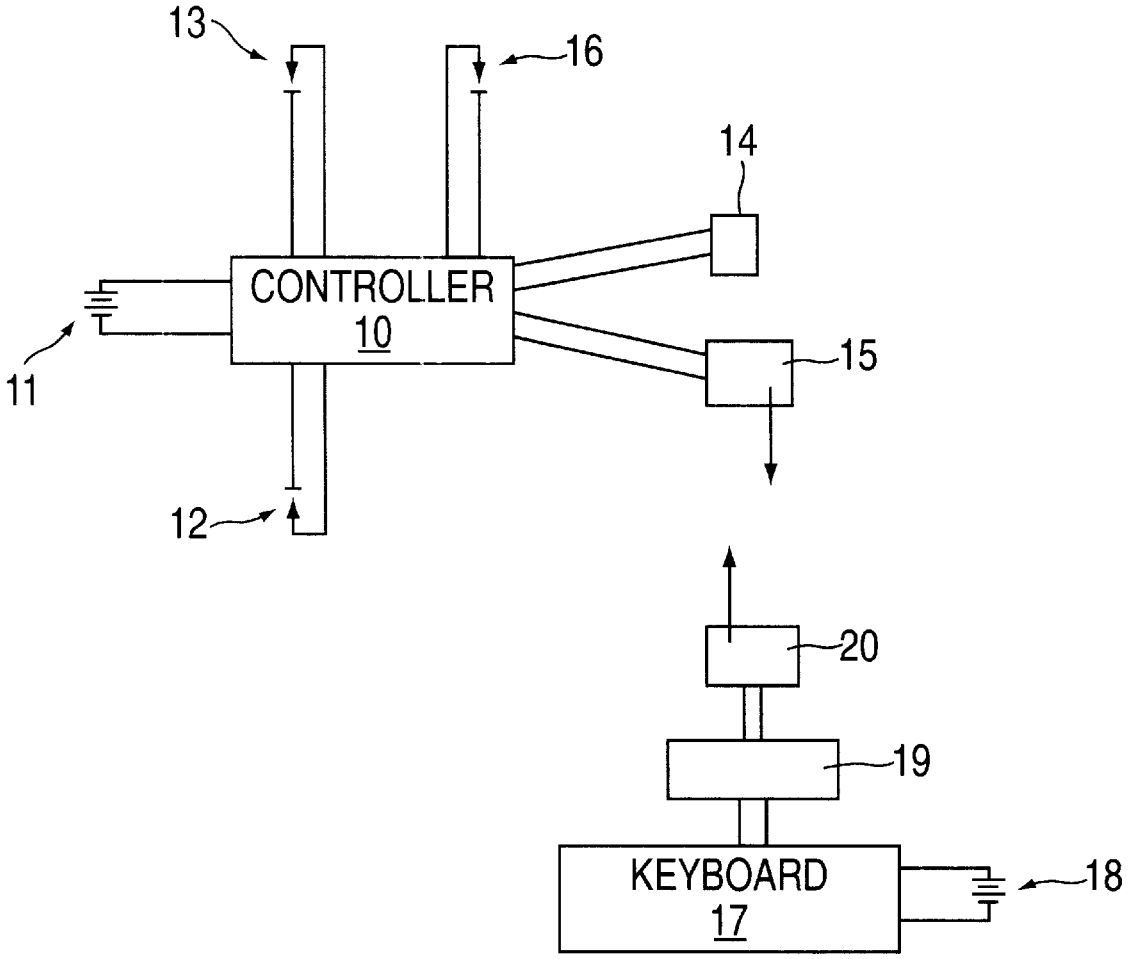
FIG. 1 shows a schematic block diagram of the communication system.

An electrical controller 10 is powered by batteries 11 and connected to manually operated switches 12 and 13. A loudspeaker 14 and a first infra-red transceiver 15 are connected to the controller. A manually operated switch 16 is used to provide a wake-up call. The operation of such an arrangement is well understood in the art (for incorporating generally inside a doll) and is arranged so that on first closure of the switch 16 a "wake-up" call turns on the power supply to the controller 10. Thereafter the controller provides signals to the loudspeaker 14 and to the transceiver 15 as required and explained more fully below. The power is automatically turned OFF during inactive periods of time in well-known manner.

A keyboard 17 has a battery power supply 18. A microprocessor 19 is connected to the keyboard 17 and a second infra-red transceiver 20. The microprocessor is programmed to respond to operations of the keyboard by a user and control the operation of the communication system in a manner described below. The keyboard and microprocessor are generally powered at all times and in a standby mode when the doll is not being played with. A "first" transmission from the doll turns the microprocessor fully ON.

Figure 2:
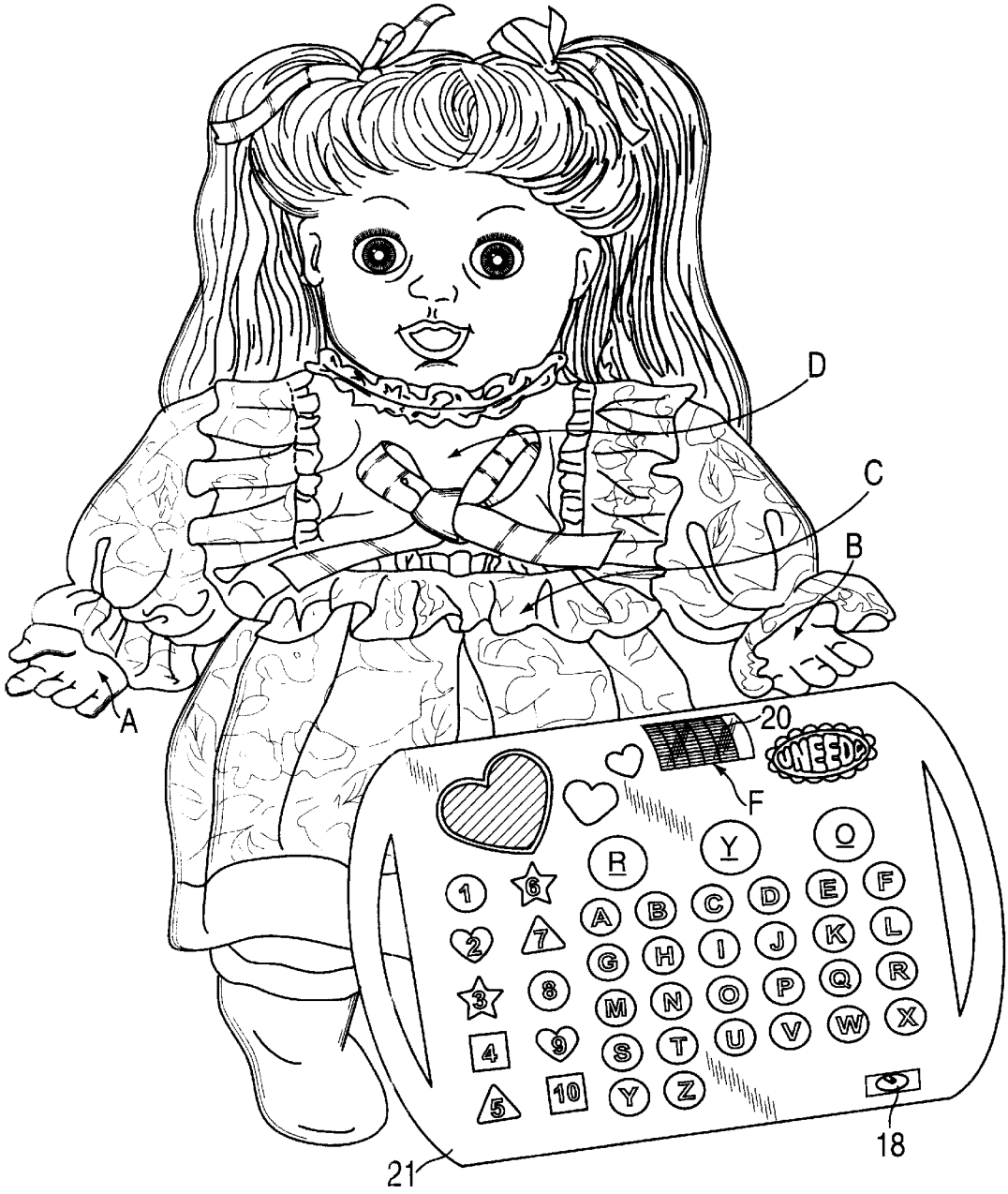
FIG. 2 shows a talking doll and a keyboard.

In FIG. 2, a doll has the switches 12, 13 and 16 respectively mounted inside its hands at A and B and at C. The transceiver 15 mounted at D. The keyboard 17 has the transceiver 20 mounted behind a window F adjacent an outside surface of a casing 21 of the keyboard and incorporates the power supply 18 and the microprocessor 19 inside the casing 21. The keyboard provides a plurality of letters that make up a full alphabet, a set of numbers 1 to 10 which are mounted on keys of a five different shapes (circle, heart, star, square and triangle). The keyboard has three control buttons that are normal coloured and shown in FIG. 2 as Red (R) Yellow (Y), and Orange (O).

The communication system is arranged and programmed so that a user is verbally asked to perform various functions or make choices by the doll and the user responds by selecting and pressing chosen keys on the keyboard 17. As the doll's instructions are carried out, the doll speaks to the user to indicate whether the user's reaction is correct or not. If necessary, an instruction incorrectly carried out is repeated by the doll to allow the user to try again. The doll may request the simple pressing of a selected key to identify a number, a letter or a shape. For somewhat more sophisticated play, the doll may ask the user to solve an arithmetic problem. "What is two plus three" for example. "Please spell cat" and so forth. In this way not only is the system much more reactive and interesting than previous known talking dolls but can also be used as an educational aid.

It is proposed to provide programmes in some cases that enables the doll to tell stories and for the user to select one or more stories that the user wishes to hear.

Figure 3:
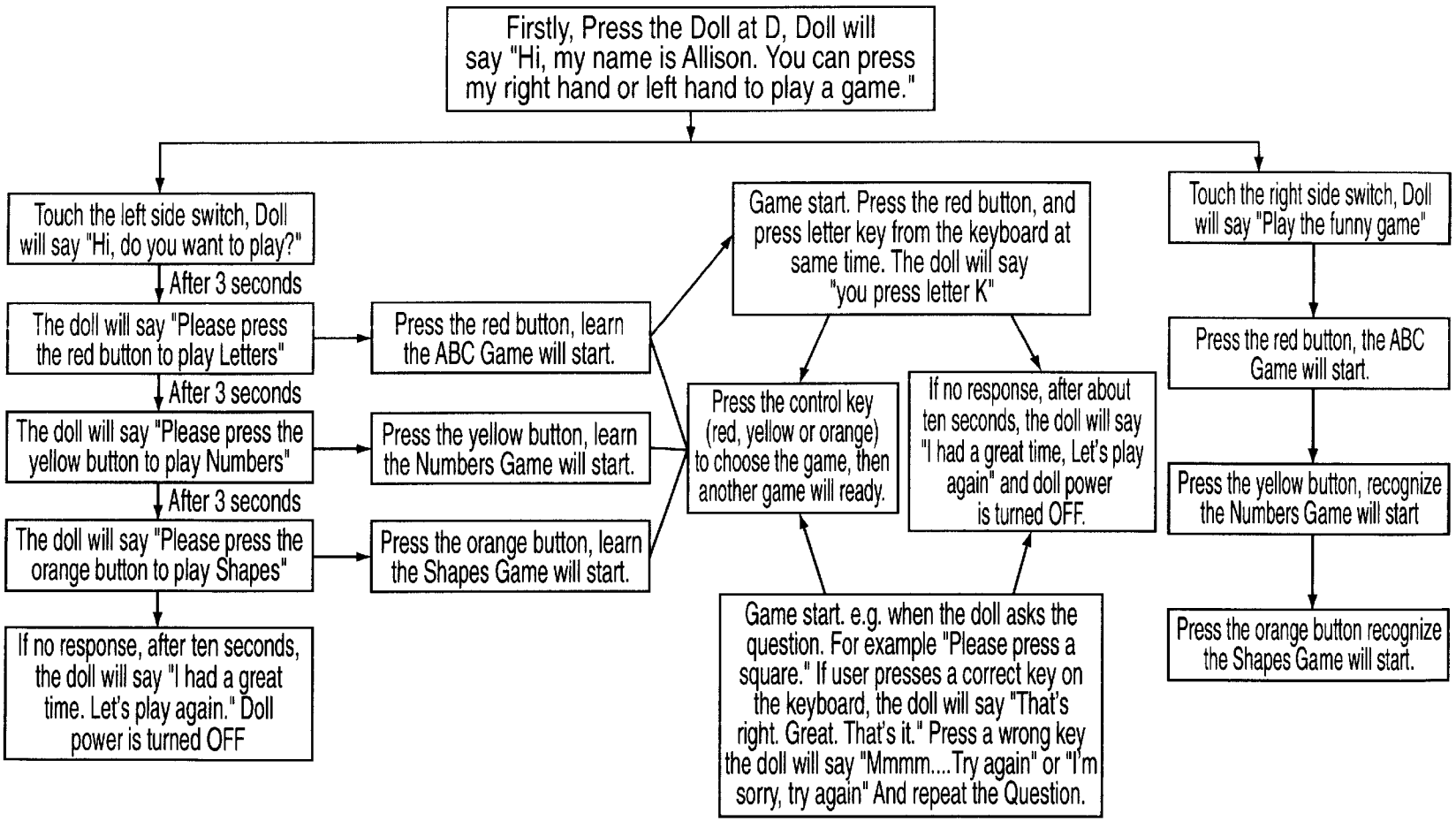
FIG. 3 shows a flow chart of typical sequence of operation of the communication system in use.

In FIG. 3, a flow chart indicates a typical sequence of events and reactions arising from the programme in the microprocessor 19.

To start a game or activity with the doll the switch 16 at D is pressed. The doll "wakes up" and sends a first message that in effect turns ON the microprocessor 19, which normally otherwise is always in a standby mode absent any activity. The doll introduces herself and asks the user to play. The flow chart shows various options and sequences that can follow from the starting point.

As already indicated above, the microprocessor 19 may be programmed to deliver more sophisticated games or educational tasks, as well as arrange for the doll to tell the user a number of selectable stories. Importantly, the user can, by making use of the keyboard, fully interact with the doll so that games and user choices are more interesting and versatile than presently possible with talking dolls.

I claim:

1. A communication system for a talking doll using infra-red signals, including a microprocessor and a keyboard, a first transceiver at the doll and a second transceiver at the keyboard, in which the microprocessor is programmed to respond to interrogation signals received at the second transceiver from the first transceiver to respond to user chosen consequential operations of the keyboard, and to cause comment signals to pass from the second transceiver to the first transceiver to enable the doll to verbally react to each chosen keyboard operation, wherein said communication system includes two or more manually operated power switches mounted to the doll to cooperatively "wake up" a power supply in the doll, the two or more manually operated power switches being mounted inside the doll and being operated by manually pressing against an outside surface of the doll.

2. A communication system for a talking doll according to claim 1, including one or more selectively operated signal initiation switches mounted to the doll to initiate respective signals at the first transceiver.

3. A communication system for a talking doll according to claim 2, in which each signal initiation switch is manually operable.

4. A communication system for a talking doll according to claim 3, in which each signal initiation switch is mounted inside the doll and is operated by manually pressing against an outer surface of the doll.

5. A communication system for a talking doll according to claim 1 in which the keyboard includes keys for each of a number of letters.

6. A communication system for a talking doll according to claim 5, in which the letters comprise a complete alphabet.

7. A communication system for a talking doll according to claim 1, in which the keyboard includes keys for each of a plurality of different numbers.

8. A communication system for a talking doll according to claim 1, in which the keyboard includes keys for each of a plurality of different shapes.

* * * * *